US006223787B1

(12) United States Patent
Graham

(10) Patent No.: US 6,223,787 B1
(45) Date of Patent: May 1, 2001

(54) METHOD AND APPARATUS FOR DISPENSING POWDER

(76) Inventor: Dominique Graham, 4119 Calle Bienvenido, San Clemente, CA (US) 92672

( * ) Notice: Subject to any disclaimer, the term of this patent is extended or adjusted under 35 U.S.C. 154(b) by 0 days.

(21) Appl. No.: 09/353,532

(22) Filed: Jul. 14, 1999

Related U.S. Application Data

(60) Provisional application No. 60/092,987, filed on Jul. 16, 1999.

(51) Int. Cl.[7] ..... B65B 1/04

(52) U.S. Cl. ..... 141/2; 141/18; 141/114; 15/209.1; 15/229.14

(58) Field of Search ..... 141/2, 18, 114; 15/209.1, 229.14; 132/320, 317

(56) References Cited

U.S. PATENT DOCUMENTS

| | | | |
|---|---|---|---|
| 323,255 | | 7/1885 | Bailey . |
| 346,773 | | 8/1886 | Rees . |
| 785,951 | | 3/1905 | Hull . |
| 1,168,430 | | 1/1916 | Schroder . |
| 1,406,439 | | 2/1922 | Boyler . |
| 1,567,503 | | 12/1925 | Hershey . |
| 1,616,197 | | 2/1927 | Parr . |
| 1,715,827 | | 6/1929 | Franck . |
| 1,801,898 | | 4/1931 | Biondi . |
| 1,824,226 | | 9/1931 | Mureau . |
| 1,887,194 | * | 11/1932 | Charroin . |
| 1,944,204 | | 1/1934 | Wutzke et al. . |
| 1,979,294 | | 11/1934 | Stimson . |
| 1,987,130 | | 1/1935 | Shapero . |
| 2,009,794 | | 7/1935 | Winsor . |
| 2,176,831 | | 10/1939 | Zimmerman . |
| 2,204,605 | | 6/1940 | Landsman . |
| 2,216,522 | | 10/1940 | Sanders . |
| 2,225,540 | | 12/1940 | Tainton . |
| 2,317,662 | | 4/1943 | Zimmerman . |
| 2,329,267 | | 9/1943 | Harllee . |
| 2,450,919 | | 10/1948 | Runnels . |
| 2,852,795 | | 9/1958 | Hermanson et al. . |
| 4,572,690 | | 2/1986 | Savanuck . |
| 4,698,871 | * | 10/1987 | Patkos ..... 15/118 |
| 6,006,761 | * | 12/1999 | Meledandri ..... 132/320 |

* cited by examiner

*Primary Examiner*—Steven O. Douglas
(74) *Attorney, Agent, or Firm*—Blakely, Sokoloff, Taylor & Zafman LLP

(57) ABSTRACT

A powder dispensing apparatus for application of loose powder and a method for creating the powder dispensing apparatus. With respect to the powder dispensing apparatus, it includes a front face made of porous material, a back face made of non-porous material, and a semi-rigid, inner pad inserted between the front and back faces. The back face is attached to the front face. Loose powder is filled within an internal chamber of the powder dispensing apparatus between the inner pad and the front face.

13 Claims, 1 Drawing Sheet

METHOD AND APPARATUS FOR DISPENSING POWDER

CROSS-REFERENCES TO RELATED APPLICATIONS

This application claims the benefit of U.S. Provisional Application No. 60/092,987 filed on Jul. 16, 1999.

BACKGROUND

1. Field

The present invention relates to the field of cosmetics. In particular, this invention relates to a powder dispensing apparatus containing powder and a method for creating the power dispensing apparatus.

2. General Background

For centuries, cosmetics have been used to enhance one's physical appearance. One popular type of cosmetic is powder which, in many cases, is applied to one's skin through the use of a powder puff. Typically, a "powder puff" comprises a circular-shaped applicator having one or more sides made of velour.

In a standard embodiment, a powder puff is stored in a compact along with pressed powder. When applying powder, a front velour side of the powder puff is rubbed against the pressed powder and then passed along the skin. One problem with pressed powder, however, is that it becomes heavy and caked after repeated applications. This caking accentuates the user's facial lines, which defeats the general purpose of the cosmetic.

In order to avoid the problems associated with pressed powder, "loose" powder may be used. Normally, loose powder is applied by either a powder puff or a powder brush. When using a powder puff, loose powder is placed on its exterior front side by dipping the powder puff into a container filled with the loose powder or sprinkling the powder thereon. However, during application when the powder puff is brushed against one's skin, it is likely that power would not be evenly distributed along the skin. Also, it is likely that any excess powder will fall from the powder puff, perhaps into the user's eyes, hair or even on the user's clothing. The loss of this excess powder causes the user to incur unnecessary costs in purchasing more powder due to its inefficient application and in cleaning soiled clothing.

Hence, it would be advantageous to provide a powder puff, which avoids the problems described above and allows for a controlled and even distribution of loose powder to the skin.

SUMMARY OF THE INVENTION

The present invention relates to a powder dispensing apparatus for application of loose powder and a method for creating the apparatus. The powder dispensing apparatus includes a front face made of porous material, a back face made of non-porous material and a semi-rigid inner pad made of non-porous material. The front face is attached to the back face and contains the inner pad. Loose powder is filled within an internal chamber of the powder dispensing apparatus between the inner pad and the front face.

BRIEF DESCRIPTION OF THE DRAWINGS

The features and advantages of the present invention will become apparent from the following detailed description of the present invention in which.

DETAILED DESCRIPTION OF AN EMBODIMENT OF THE INVENTION

As described, the present invention relates to a powder dispensing powder puff. Herein, certain terminology is used to describe various features of the powder puff. For example, "powder" is defined as any granular substance applied to a person's skin such as facial cosmetic powder, scented or unscented body powder, baby powder and the like.

Figure 1:
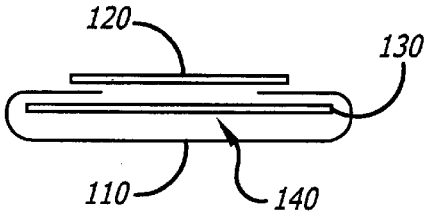
FIG. 1 is a cross-sectional view of an illustrative embodiment of a powder dispensing apparatus filled with loose powder and sealed.

Referring to FIG. 1, a cross sectional view of an illustrative embodiment of a powder dispensing apparatus ("powder puff") 100 is shown. Powder puff 100 comprises (i) a front face 110 and (ii) a back face 120, both of which surrounding an inner buffer pad 130 providing semi-rigidity to powder puff 100. In this embodiment, buffer pad is a non-porous semi-rigid material (e.g., paper/cotton fiber). For example, the inner pad 130 may be cotton material bordered by two sheets of semi-rigid cotton paper. Front face 110 is made of a porous material such as, for example, velour cloth. Of course, materials of different porosity may be used besides velour cloth. Attached to front face 110, back face 120 is made of a non-porous, flexible material (e.g., a satin cloth) which prevents the powder from escaping. Powder is poured into an interior chamber 140 between inner buffer pad 130 and front face 110.

Figure 2:
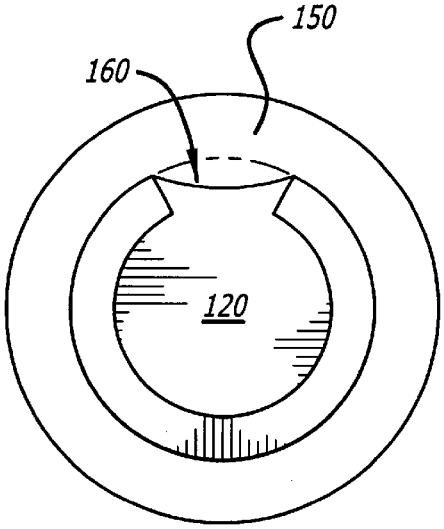
FIG. 2 is a plan view of an illustrative embodiment of the back face of the powder dispensing apparatus prior to filling.

Referring now to FIG. 2, a plan view of an illustrative embodiment of back face 120 of powder dispensing powder puff 100 is shown. Initially, a substantial portion of the perimeter of back face 120 is attached to front face 110. It is contemplated that many types of attachment techniques may be used, so long as no unwanted openings between front side 110 and back side 120 are created. One attachment technique involves heat-sealing back face 120 around its perimeter, but initially leaving an area 150 of front face 110 and an area 160 of back face 120 unsealed as further shown in FIG. 3. In this embodiment, these areas 150 and 160 are generally along the perimeter of faces 110 and 120.

When forces are applied against the joined perimeters of faces 110 and 120, areas 150 and 160 form an opening 170 to allow powder 180 to be poured into internal chamber 140. In this embodiment, opening 170 has a width of approximately one inch; however, opening 170 may range from 0.5 inches up to 2 inches.

Figure 4:
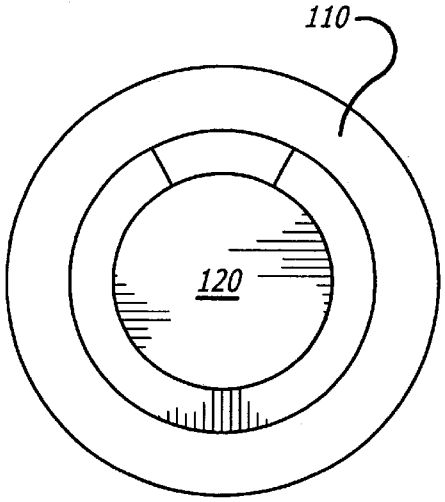
FIG. 4 is a plan view of an illustrative embodiment of the backing of the powder dispensing apparatus after filling.
Figure 3:
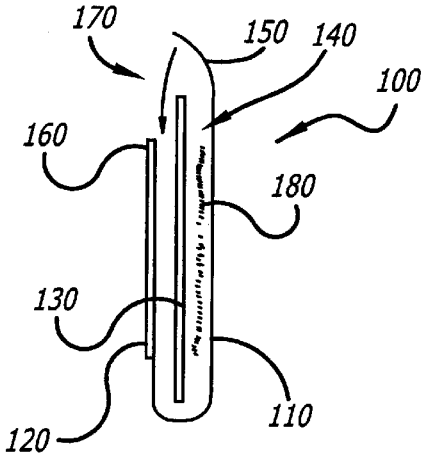
FIG. 3 is a cross-sectional view of an illustrative embodiment of the powder dispensing apparatus having the front face unsealed and open in a position for filing.

Referring still to FIG. 3, after powder puff 100 has been filled with powder, area 160 is attached to area 150. In this embodiment, front face 110 along area 150 is folded inward before being attached to area 160 of back face 120. When the attachment is through heat-sealing, it is more permanent in construction. As a result, as shown in FIG. 4, the entire perimeter of back face 120 is now sealed to front face 110 with powder retained in internal chamber 140. Thus, when pressure is applied to front face 110 of powder puff 100, loose powder 180 is evenly distributed through the porous material of front face 110 to escape internal chamber 140. The amount of loose powder 180 released is controlled, in part, by the porosity of the material forming front face 110.

While certain exemplary embodiments have been described and shown in the accompanying drawings, it is to be understood that such embodiments are merely illustrative of and not restrictive on the broad invention. Also, it is understood that this invention not be limited to the specific constructions and arrangements shown and described, since various other modifications may occur to those ordinarily skilled in the art.

What is claimed is:

1. A powder dispensing apparatus comprising:

a porous material;

a non-porous material;

a semi-rigid inner pad placed between the porous material and the non-porous material; and loose powder placed within an internal chamber between the inner pad and the porous material, wherein a perimeter of the non-porous material is attached to a perimeter of the porous material after the loose powder is placed within the internal chamber between the inner pad and the porous material.

2. The powder dispensing apparatus of claim 1, wherein the non-porous material is permanently attached to porous material.

3. The powder dispensing apparatus of claim 1, wherein the porous material provides generally even distribution of the loose powder.

4. The powder dispensing apparatus of claim 1, wherein the perimeter of the non-porous material is attached to the perimeter of the porous material by heat-sealing.

5. A method for filling a powder dispensing apparatus comprising:

providing the powder dispensing apparatus including a porous front face, a semi-rigid inner pad, and a non-porous back face having a first portion of its perimeter heat-sealed to a second portion of a perimeter of the front face in order to contain the inner pad and to leave portions of corresponding perimeters of the front and back faces non-sealed;

applying force against the sealed perimeters of the front and back faces to produce an opening formed by the non-sealed portions of the corresponding perimeters of the front and back faces; and pouring powder through the opening for temporary retention between the inner pad and the porous material.

6. The method of claim 5, wherein the opening is greater than one-half of an inch.

7. The method of claim 5 further comprising permanently sealing the opening so that the entire perimeter of the front face is attached to the perimeter of the back face.

8. The method of claim 5 further comprising:

folding the non-sealed portion-of the front face inward toward the non-sealed portion of the back face; and attaching the folded non-sealed portion of the front face to the non-sealed portion of the back face.

9. The method of claim 8, wherein the attaching of the folded non-sealed portion of the front face to the non-sealed portion of the back face is performed by heat-sealing.

10. A method for creating a powder dispensing apparatus comprising:

providing a flexible porous material;

providing a flexible non-porous material;

inserting a semi-rigid, non-porous pad between the non-porous material and the porous material to create an internal chamber;

substantially sealing a perimeter of the porous material to a perimeter of the non-porous material to leave a portion of the perimeter of the porous material unsealed to a corresponding portion of the perimeter of the non-porous material;

applying a force to the sealed perimeters of the porous and non-porous materials to create an opening at the non-sealed portions of the perimeters of the porous and non-porous materials;

inserting powder through the opening for placement in the internal chamber; and sealing the non-sealed portion of the perimeter of the non-porous material to the non-sealed portion of the perimeter of the porous material.

11. The method of claim 10, wherein the internal chamber is situated between the porous material and the non-porous pad.

12. A powder dispensing apparatus comprising:

a porous material being a velour cloth;

a non-porous material;

a semi-rigid inner pad placed between the porous material and the non-porous material; and loose powder placed within an internal chamber between the inner pad and the porous material.

13. A powder dispensing apparatus comprising:

a porous material;

a non-porous material;

a semi-rigid inner pad placed between the porous material and the non-porous material, the semi-rigid inner pad is a cotton material bordered by at least two sheets of semi-rigid cotton paper; and loose powder placed within an internal chamber between the inner pad and the porous material.

* * * * *